US010034565B2

(12) United States Patent
Goetz et al.

(10) Patent No.: US 10,034,565 B2
(45) Date of Patent: Jul. 31, 2018

(54) BEVERAGE COOLING DEVICE

(71) Applicant: Vermillion Innovations, LLC, New Orleans, LA (US)

(72) Inventors: David Goetz, New Orleans, LA (US); Adam Mefford, New Orleans, LA (US); Sunay Patel, New Orleans, LA (US); Abhay Patel, New Orleans, LA (US)

(73) Assignee: Vermillion Innovations, LLC, New Orleans, LA (US)

( * ) Notice: Subject to any disclaimer, the term of this patent is extended or adjusted under 35 U.S.C. 154(b) by 410 days.

(21) Appl. No.: 14/822,470

(22) Filed: Aug. 10, 2015

(65) Prior Publication Data

US 2016/0037947 A1 Feb. 11, 2016

Related U.S. Application Data

(60) Provisional application No. 62/034,982, filed on Aug. 8, 2014.

(51) Int. Cl.
*B23Q 3/06* (2006.01)
*A47G 23/02* (2006.01)

(52) U.S. Cl.
CPC .. *A47G 23/0241* (2013.01); *A47G 2023/0275* (2013.01)

(58) Field of Classification Search
CPC ..... B25B 17/00; B25B 33/00; B67B 7/00
See application file for complete search history.

(56) References Cited

U.S. PATENT DOCUMENTS 2,216,762 A * 10/1940 Bolas ..... F25D 31/007 366/149
2,405,091 A * 7/1946 Culbreth ..... F25D 31/007 134/187

(Continued)

*Primary Examiner* — Lee D Wilson
(74) *Attorney, Agent, or Firm* — Loza & Loza, LLP; Jeffrey Burgess

(57) ABSTRACT

A beverage cooling device for the rapid cooling of the content of canned or bottle beverages is provided. The beverage cooling device is a handheld device that easily engages the top of a can or beverage. The beverage cooling device includes a housing with side walls for mounting a motor. A container engagement member is attached to the motor along the bottom side of the housing such that it is able to freely rotate within the side walls of the housing. The container engagement member is attached to the drive shaft of the motor such that it is able to rotate when the motor is actuated. The container engagement member includes, at its center, a central gripping member for gripping the top of containers with long narrow necks. The container engagement member further includes peripheral gripping members for engaging containers having tops of larger circumferences, such aluminum beverage containers of varying sizes. The motor is actuated by an on/off switch. The motor rotates the container engagement member when actuated thus enabling the rotation of bottles or containers when engaged by the container engagement member of the beverage cooling device. Rapid rotation of the beverage container in contact with a chilling substance such as ice or ice water results in a very rapid chilling of the contents of the beverage container.

20 Claims, 14 Drawing Sheets

(56) References Cited

U.S. PATENT DOCUMENTS 2,746,330 A * 5/1956 Pfetzing ..... B25B 27/0042 184/1.5
4,004,120 A * 1/1977 Lee ..... H01H 9/161 200/310
4,580,405 A * 4/1986 Cretzmeyer, III .... F25D 31/007 62/381
4,688,395 A * 8/1987 Holcomb ..... F25D 3/107 62/294
4,951,890 A * 8/1990 Sossamon ..... A01K 89/003 242/250
5,005,378 A * 4/1991 Ottenheimer ..... F25D 3/08 62/378
5,054,733 A * 10/1991 Shields ..... B60N 3/101 248/154
5,167,172 A * 12/1992 Heebner ..... B67B 7/182 81/3.07
5,282,368 A * 2/1994 Ordoukhanian ..... F25D 31/007 248/214
5,317,964 A * 6/1994 Prudhomme ..... A47J 43/24 210/369
5,505,054 A 4/1996 Loibl et al.
6,202,518 B1 * 3/2001 Moffitt, Jr. ..... B25B 7/00 81/418
6,314,751 B1 * 11/2001 Gjersvik ..... F25D 3/02 62/372
6,662,574 B2 * 12/2003 Loibl ..... F25B 21/04 62/64
7,086,622 B1 * 8/2006 Whaley ..... A01K 89/017 242/250
7,383,753 B1 * 6/2008 Hajianpour ..... B67B 7/182 81/3.2
7,398,714 B1 * 7/2008 Mah ..... B67B 7/182 81/3.07
7,404,345 B1 * 7/2008 Dipprey ..... B67B 7/16 81/3.09
7,637,120 B1 * 12/2009 Doss ..... F25D 3/02 62/378
2003/0079567 A1 * 5/2003 Dubois ..... B67B 7/182 81/3.2
2010/0018223 A1 * 1/2010 Sundhar ..... F25D 31/007 62/3.63
2011/0245833 A1 * 10/2011 Anderson ..... A61B 17/1626 606/80
2013/0206779 A1 * 8/2013 Wheeland ..... F25D 3/08 220/592.16
2014/0360711 A1 12/2014 Parker et al.

* cited by examiner

BEVERAGE COOLING DEVICE

RELATED APPLICATIONS

This application claims priority of U.S. Provisional Application Ser. No. 62/034,982 filed on Aug. 8, 2015, titled BEVERAGE COOLING DEVICE, which application is incorporated in its entirety by reference in this application.

FIELD OF THE INVENTION

The present invention relates to a beverage cooling device for quick chilling the contents of a beverage container by rapidly rotating the container along its longitudinal axis while emerged in a cooling substance, such as ice or ice water.

BACKGROUND OF THE INVENTION

Cylindrical containers of liquid may be rapidly cooled by rotating the container about its longitudinal axis while immersed in ice or ice water. Cooling is more rapid as the rotational speed of the container is increased. This practice is commonly used to chill the contents of beverage containers in restaurants, for example, to chill bottles of wine. Manual rotation is often time consuming and is generally not as effective because it is difficult to obtain a high speed of rotation by manual methods. Motorized rotational devices have been developed to assist in the rapid chilling of beverage containers; however, the available motorized methods are still quite limiting in that they are bulky, integrated, attached to or designed for use with only specific cold liquid containment systems (i.e., ice buckets) or only accommodate bottles of a particular size and shape.

A need therefore exists for a universal, water-tight, hand-held container rotating device capable of accommodating beverage containers of varying sizes.

SUMMARY

A beverage cooling device for the rapid cooling of the content of canned or bottled beverages is provided. The beverage cooling device is a hand held, water tight device that easily engages the top of a can, bottle or other beverage container. The beverage cooling device includes a housing with side walls for mounting a motor. A container engagement member is attached to the motor along the bottom side of the housing such that it is able to freely rotate within the side walls of the housing. The container engagement member is attached to the drive shaft of the motor such that it is able to rotate when the motor is actuated. The container engagement member includes, at its center, a central gripping member for gripping the top of containers with long narrow necks. The container engagement member further includes peripheral gripping members for engaging containers having tops of larger circumferences, such aluminum beverage containers of varying sizes. The motor is actuated by an on/off switch. The motor rotates the container engagement member when actuated, thus enabling the rotation of bottles or containers when engaged by the container engagement member of the beverage cooling device. Rapid rotation of the beverage container in contact with a chilling substance such as ice or ice water results in a very rapid chilling of the contents of the beverage container.

In one example of an implementation, the peripheral gripping members are retractable gripping fingers that open to allow for the insertion of the top of the beverage container on the container engagement member. When closed, the peripheral gripping members apply compressive force to the top of the container to engage the container for rotation. In another example of an implementation, the peripheral gripping members are tiered rubber concentric gripping rings that securely engage different sized beverage container tops within the different sized concentric rings. In a third example of an implementation, the peripheral gripping fingers are arranged circumferentially around the central gripping member and slide from a closed to a retracted and open position along slots. One end of each peripheral gripping finger forms a stationery pivot point about the container engagement member. The opposing ends of the peripheral gripping fingers include a hooked member for engaging a tension member such as a rubber band or spring. Each one of the peripheral gripping fingers further includes a raised outer edge for engaging the sides of the top of a beverage can inserted into the containing engaging member.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

Figure 3:
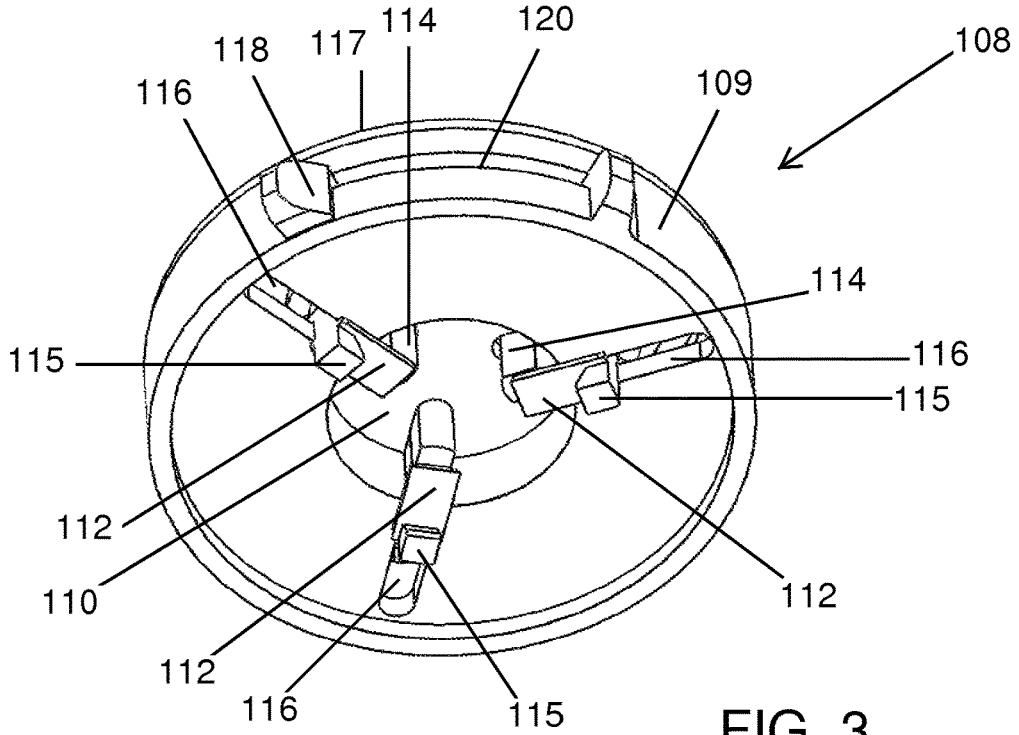
FIG. 3 is a bottom perspective of one example of a container engagement member that may be used in connection with the beverage cooling device of the present invention.

FIG. **6*a* is an exploded rear side view of the engagement member of FIG. 3**.

FIG. **6*b* is an exploded top side view of the engagement member of FIG. 3**.

Figure 7:
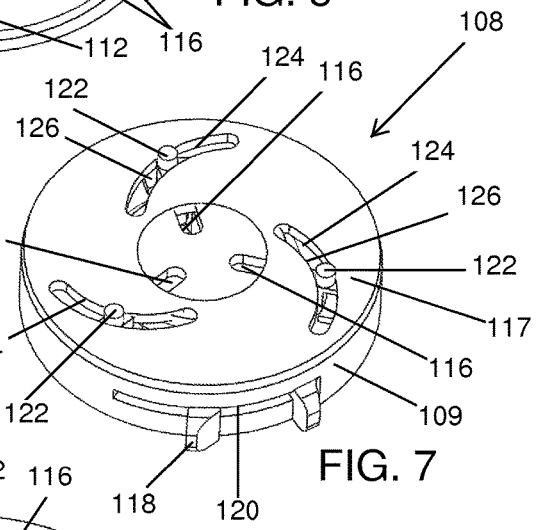

FIG. 7 is a top perspective view of the container engagement member of FIG. 3 illustrating the peripheral gripping fingers in a partially opened position.

Figure 8:
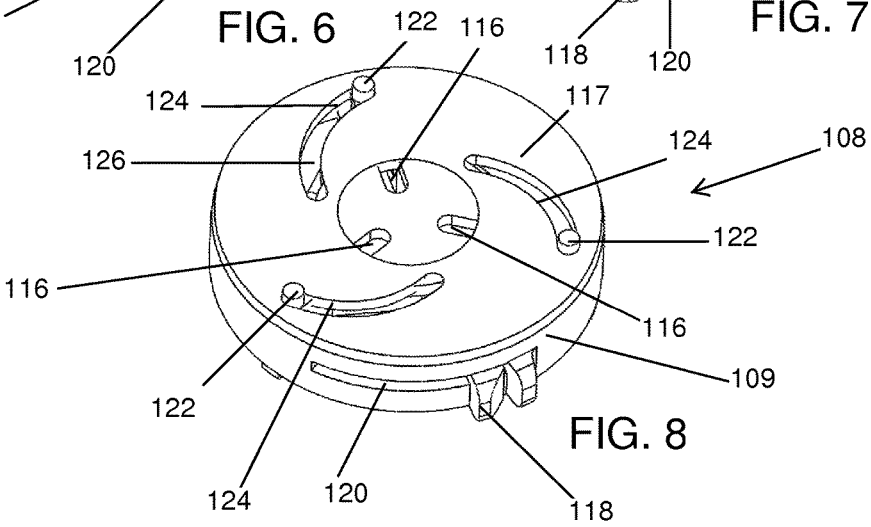

FIG. 8 is a top perspective view of the container engagement member of FIG. 3 illustrating the peripheral gripping fingers in an open position.

Figure 9:
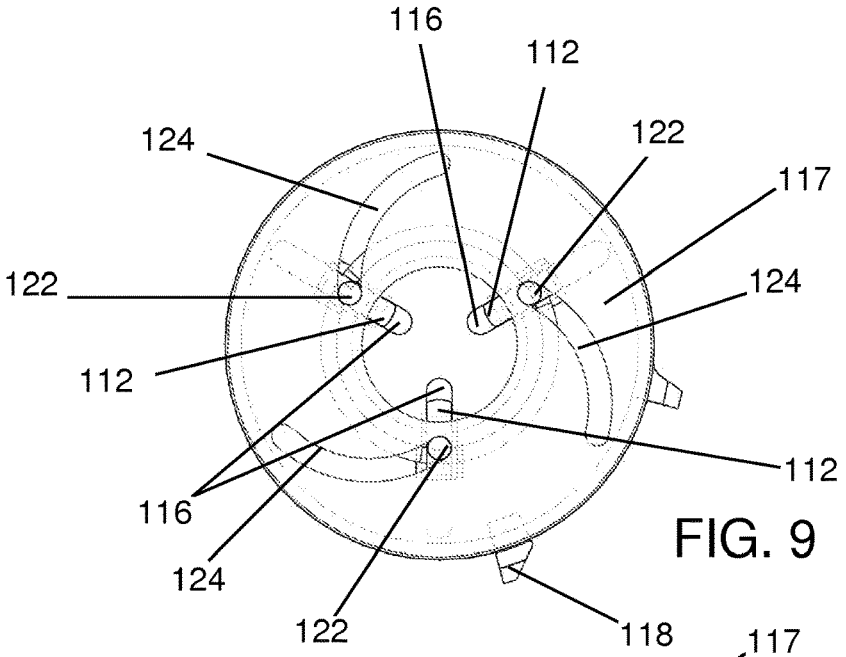

FIG. 9 is top perspective view of the container engagement member of FIG. 3 illustrating the mechanical relationship of the peripheral gripping fingers and the tension member when the peripheral gripping fingers are in the closed position.

Figure 10:
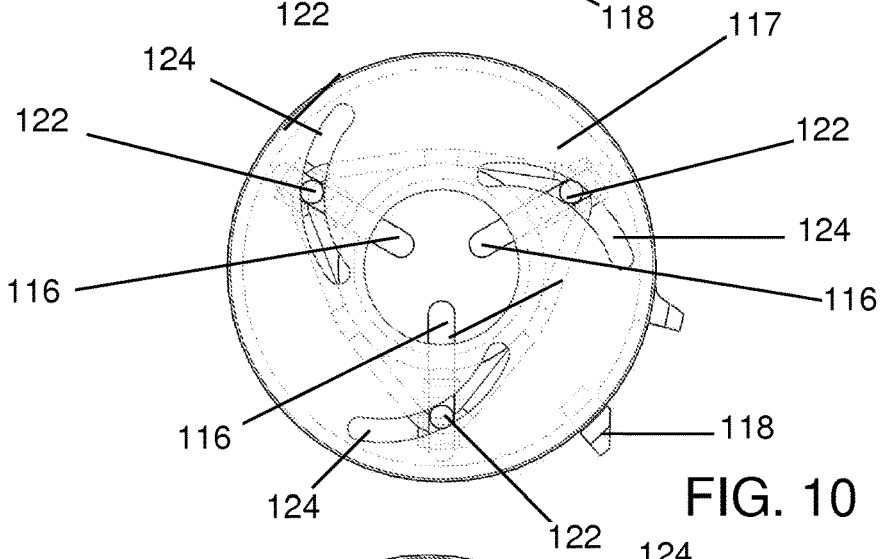

FIG. 10 is top perspective view of the container engagement member of FIG. 3 illustrating the mechanical relationship of the peripheral gripping fingers and the tension member when the peripheral gripping fingers are in a partially open position.

Figure 11:
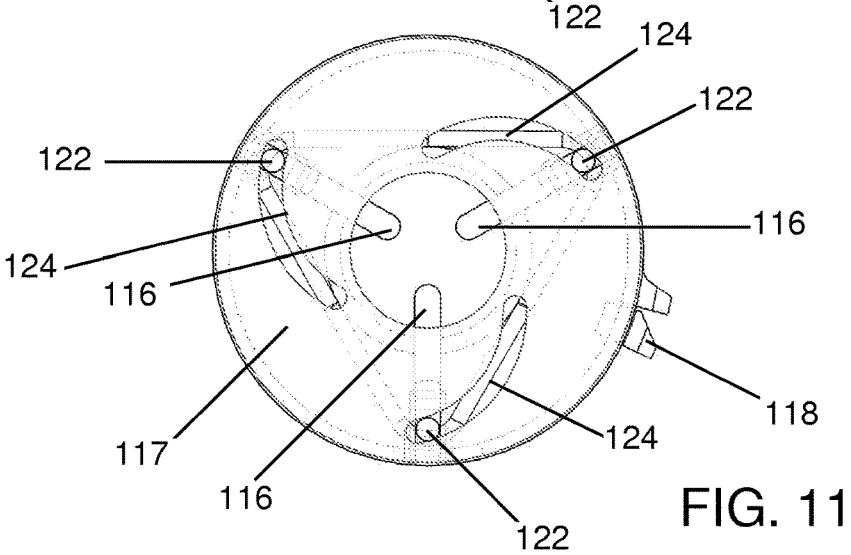

FIG. 11 is top perspective view of the container engagement member of FIG. 3 illustrating the mechanical relationship of the peripheral gripping fingers and the tension member when the peripheral gripping fingers are in an open position.

Figure 12:
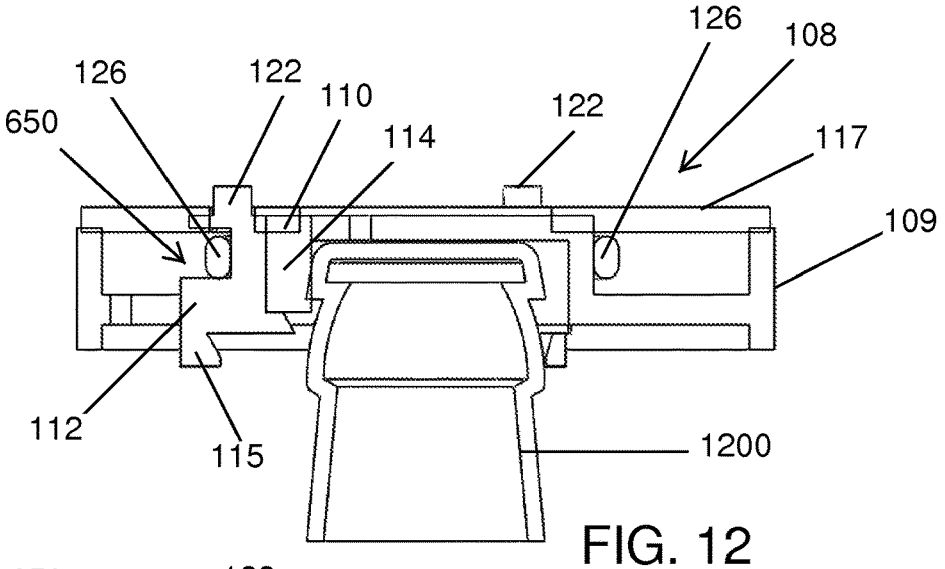

FIG. 12 is a cross-section view of the container engagement member of FIGS. 3-11 illustrating the operation of the container engagement member with a long-neck bottle by retaining the top of the long-neck bottle in the central gripping member of the container engagement member.

Figure 13:
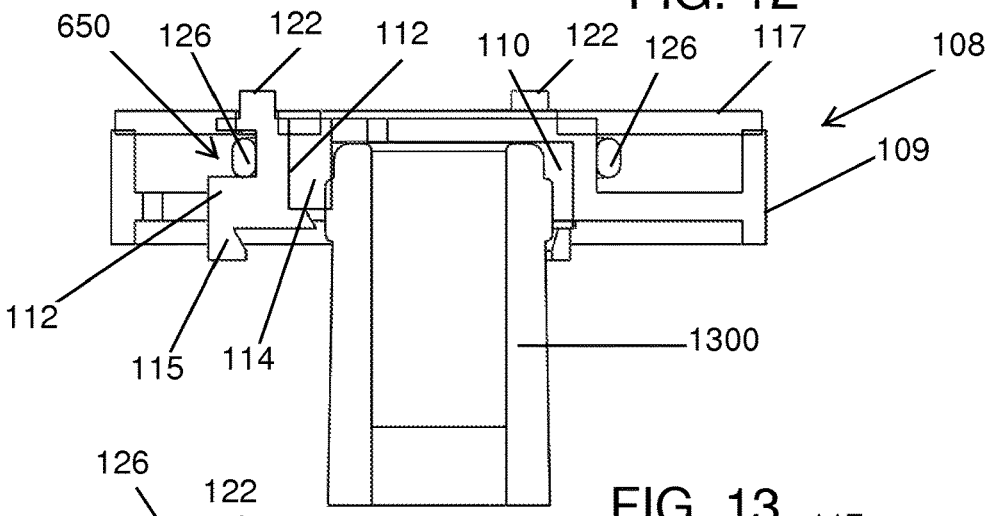

FIG. 13 is a cross-section view of the container engagement member of FIGS. 3-11 illustrating the operation of the container engagement member with a wine bottle by retaining the top of the wine bottle in the central gripping member of the container engagement member.

Figure 14:
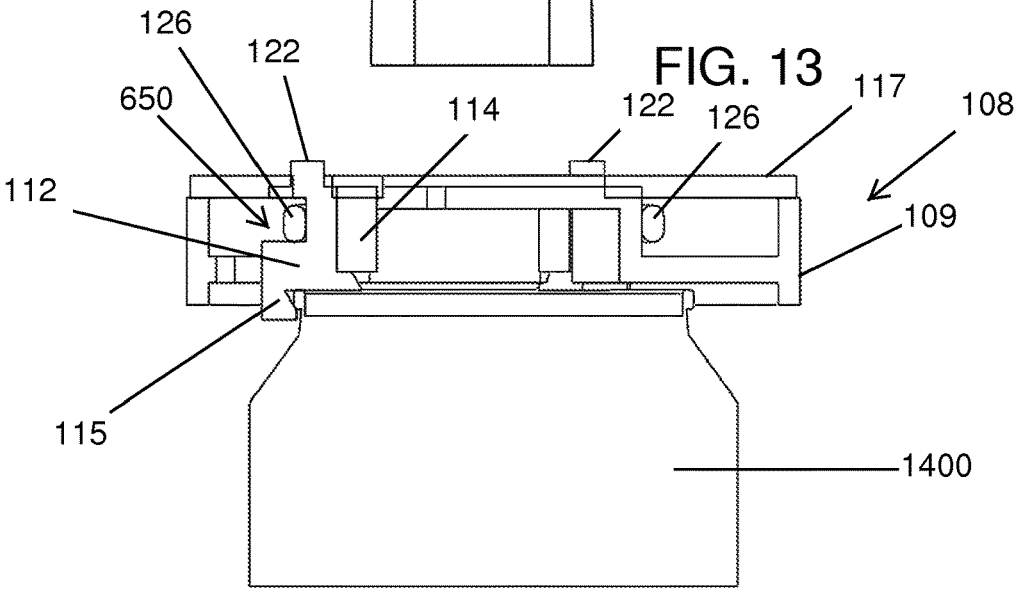

FIG. 14 is a cross-section view of the container engagement member of FIGS. 3-11 illustrating the operation of the container engagement member with an aluminum beverage can by retaining the top of the aluminum beverage can with the raised grips on the peripheral gripping fingers.

Figure 15:
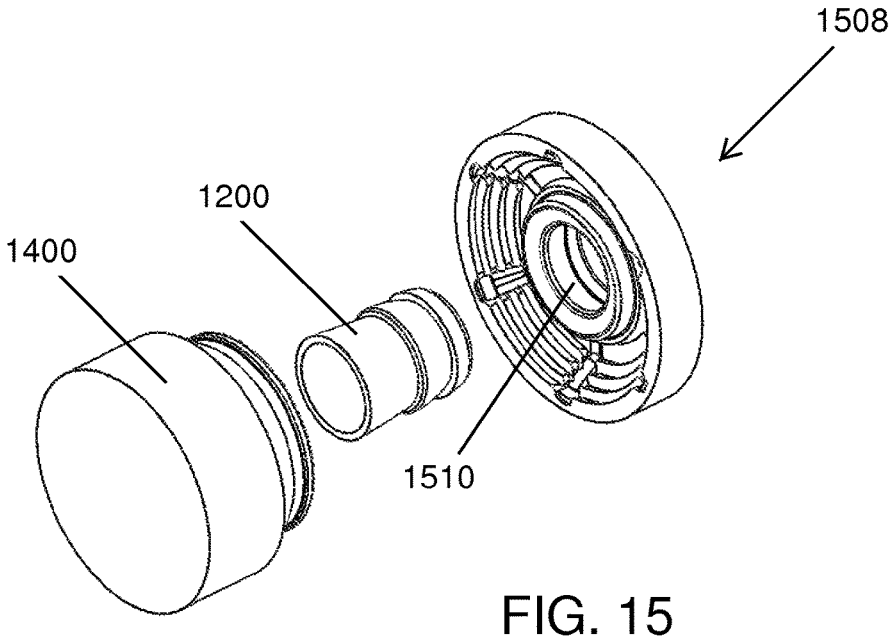

FIG. 15 is a side rear perspective view of another example of an implementation of a container engagement member that maybe utilized in connection with the present invention.

Figure 16:
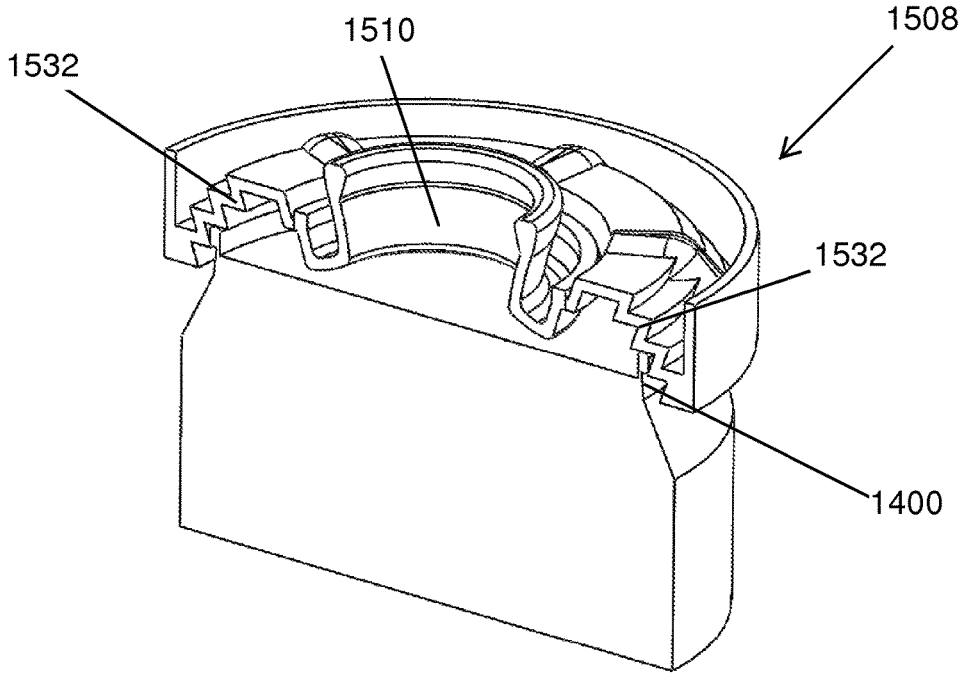

FIG. 16 is a cross-sectional side view of the container engagement member of FIG. 15.

Figure 17:
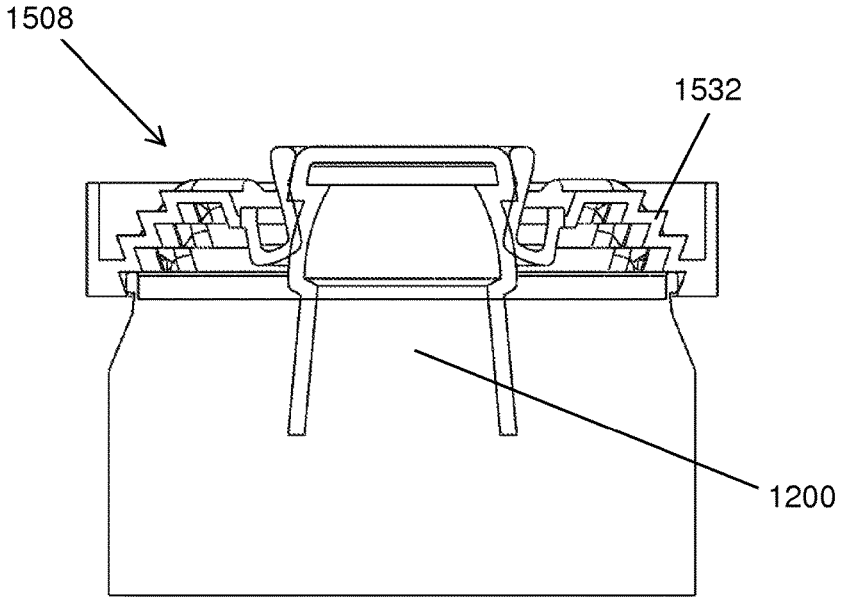

FIG. 17 is a cross-sectional side view of the container engagement member of FIG. 15 engaging a long-neck bottle within the central gripping member of the container engagement member.

Figure 18:
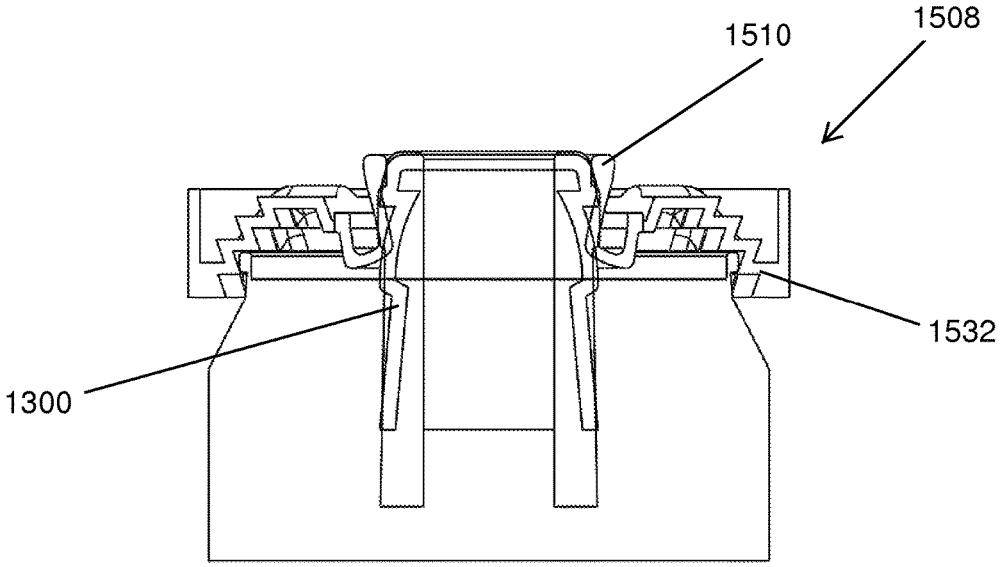

FIG. 18 is a cross-sectional side view of the container engagement member of FIG. 15 engaging a wine bottle within the central gripping member of the container engagement member.

Figure 19:
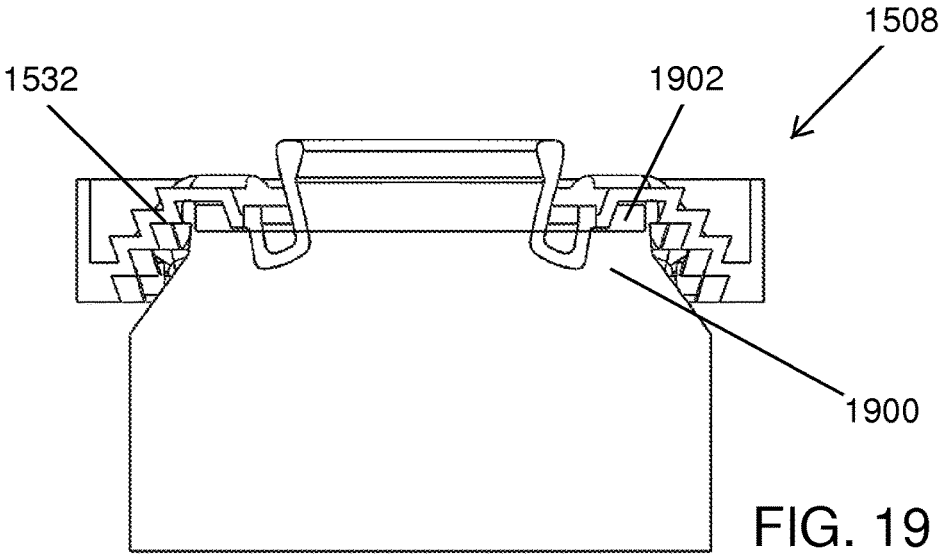

FIG. 19 is a cross-sectional side view of the tiered gripping member of the container engagement member of FIG. 15 gripping the top of a can within the first inner concentric ring of the tiered gripping member of the container engagement member.

Figure 20:
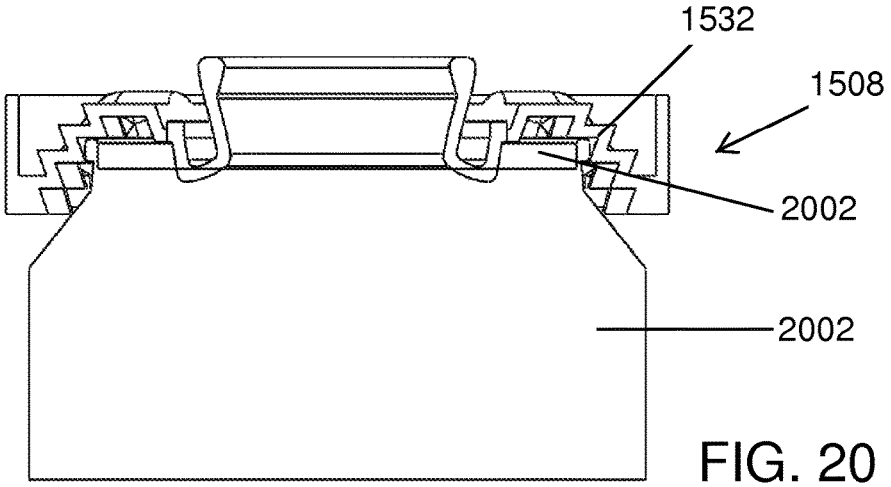

FIG. 20 is a cross-sectional side view of the tiered gripping member of the container engagement member of FIG. 15 gripping the top of a can within the second inner concentric ring of the tiered gripping member of the container engagement member.

Figure 21:
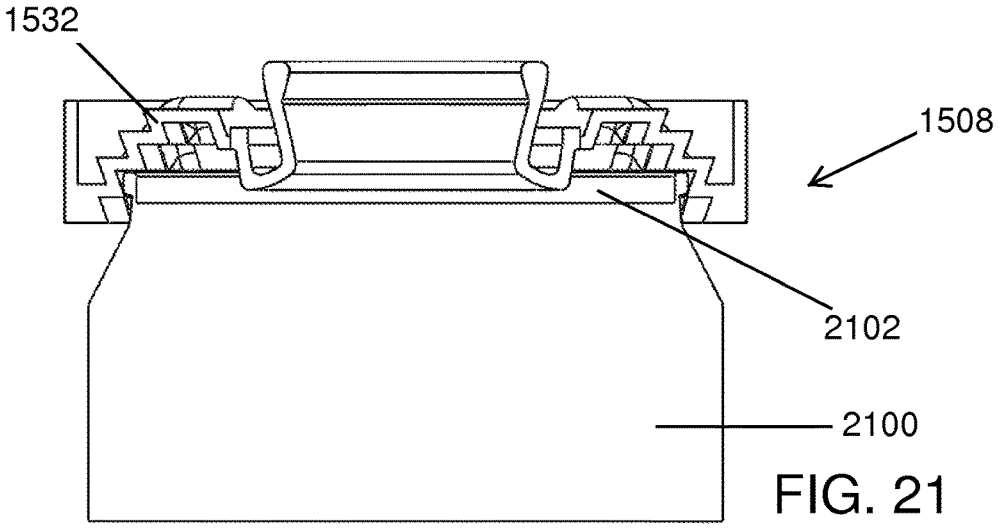

FIG. 21 is a cross-sectional side view of the tiered gripping member of the container engagement member of FIG. 15 gripping the top of a can within the third inner concentric ring of the tiered gripping member of the container engagement member.

Figure 22:
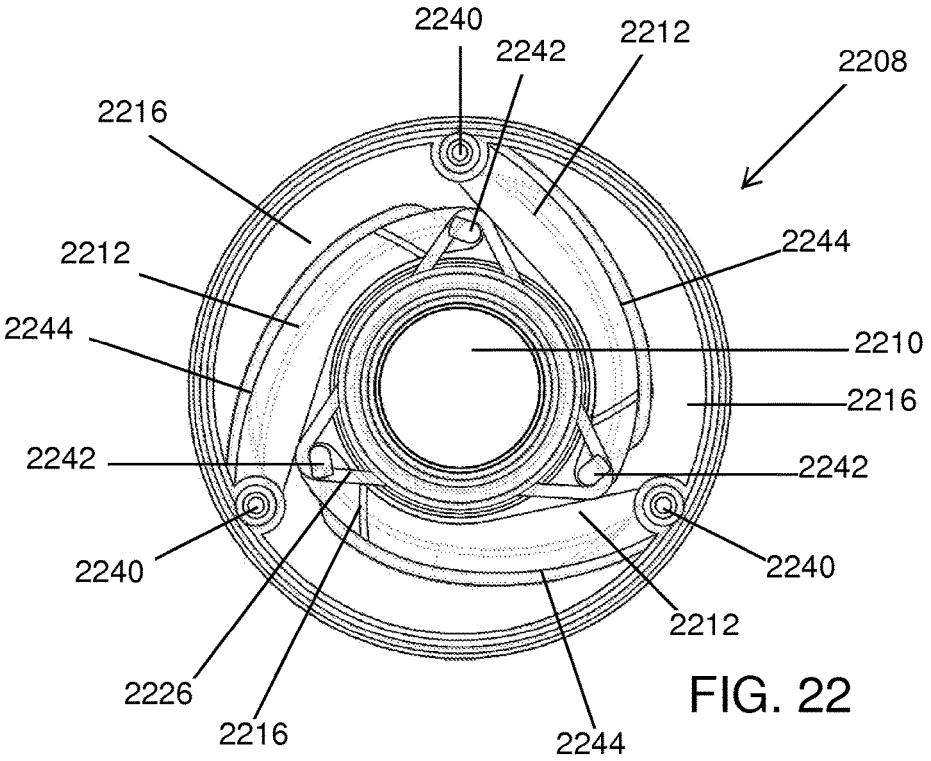

FIG. 22 is a bottom view of yet another example of an implementation of a container engagement member that may be used in connection with the present invention.

Figure 23:
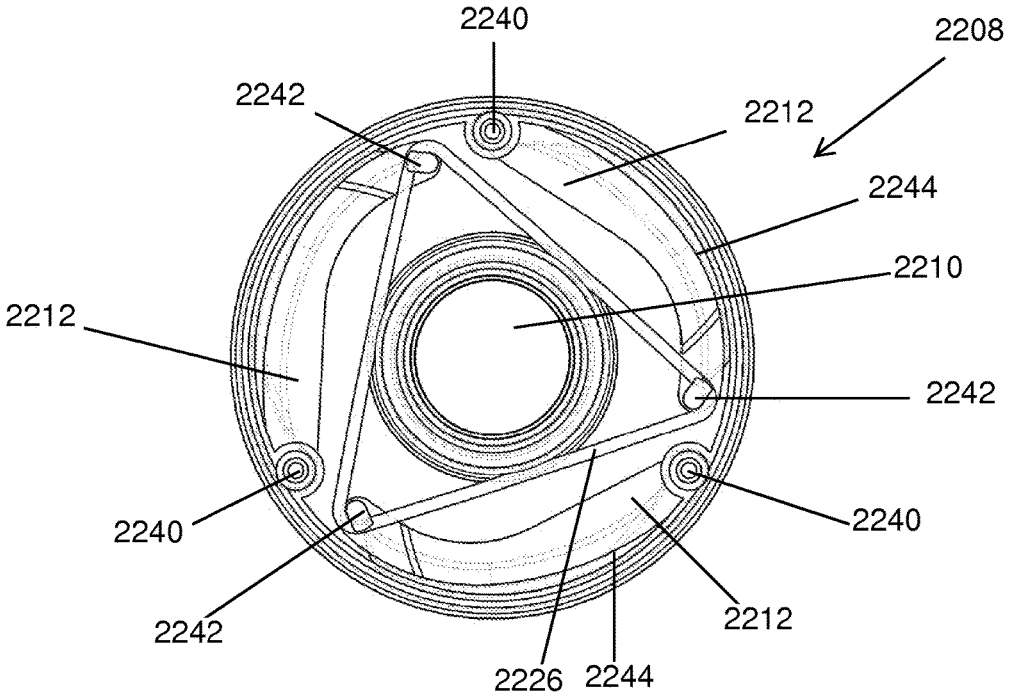

FIG. 23 is a bottom view of the container engagement member of FIG. 22 illustrating the peripheral gripping fingers in an open position.

Figure 24:
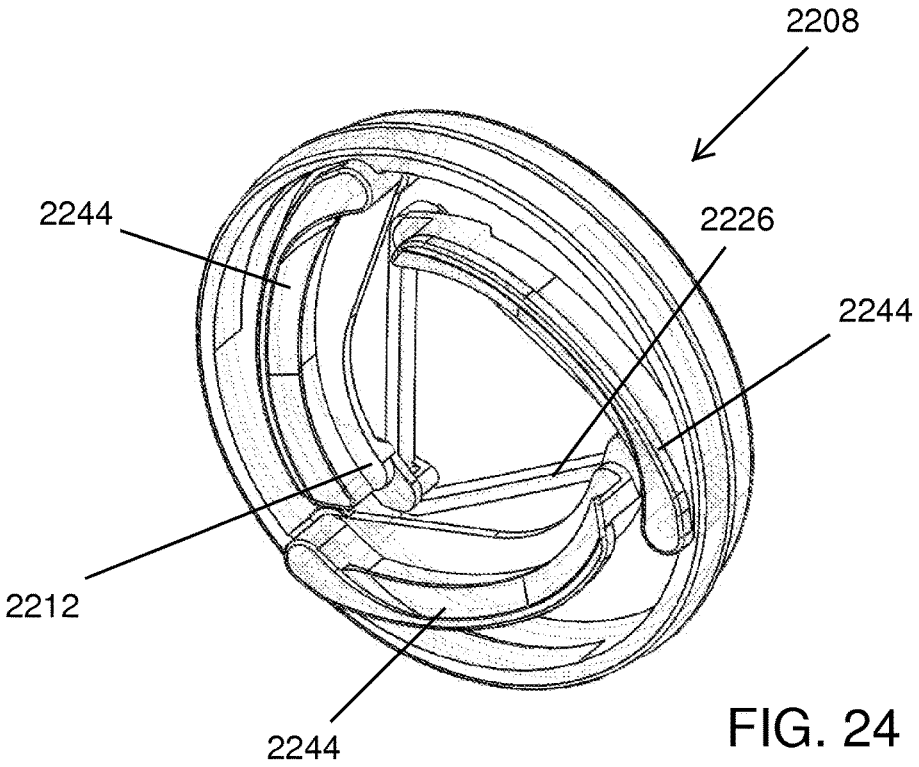

FIG. 24 is a side perspective view of the container engagement member of FIG. 22 illustrating the peripheral gripping fingers and tension member in a closed or relaxed state.

Figure 25:
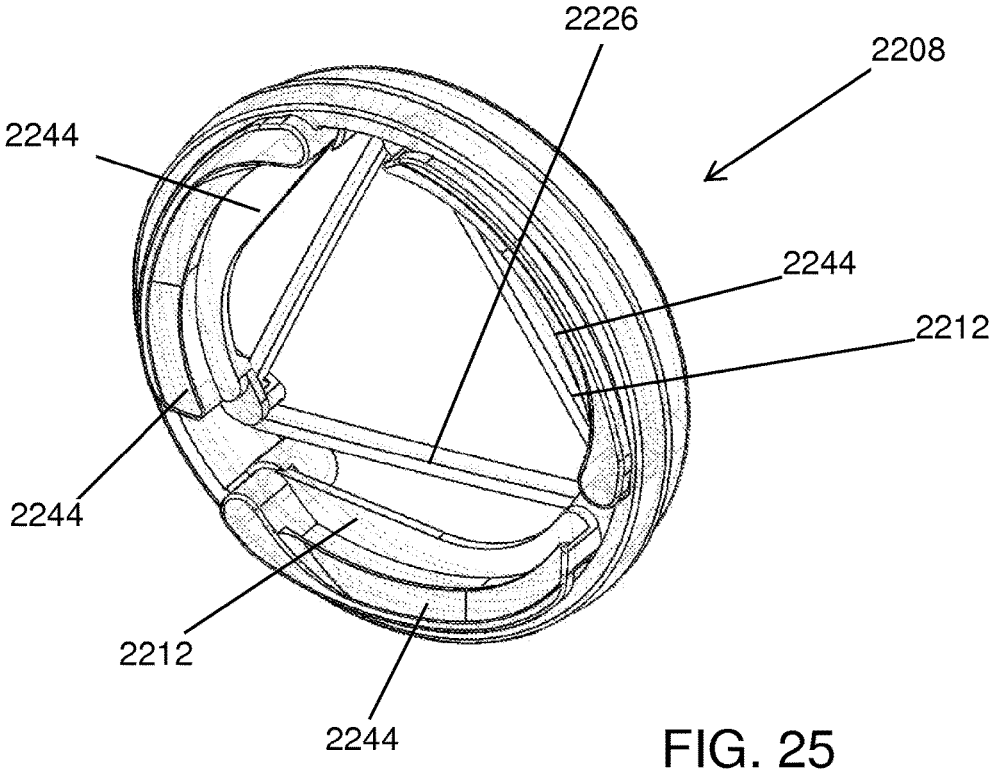

FIG. 25 is a side perspective view of the container engagement member of FIG. 23 illustrating the peripheral gripping fingers and tension member in a closed or relaxed state.

Figure 26:
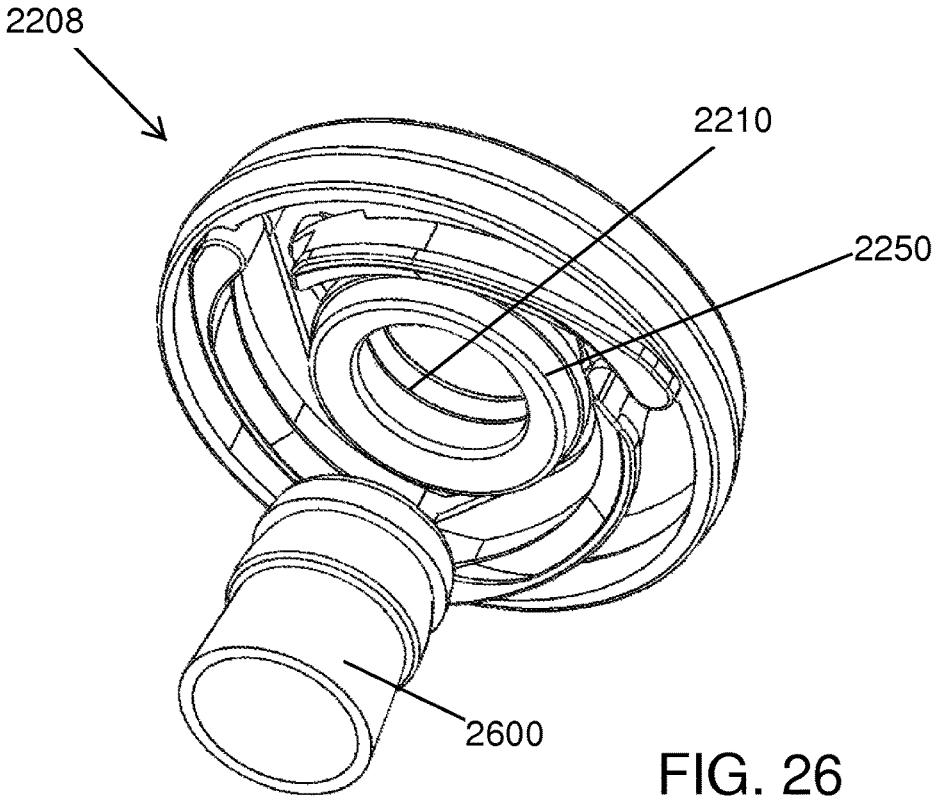

FIG. 26 is a bottom view of the container engagement member of FIG. 22 illustrating the central gripping member with a flanged member for engaging a long-neck bottle.

Figure 27:
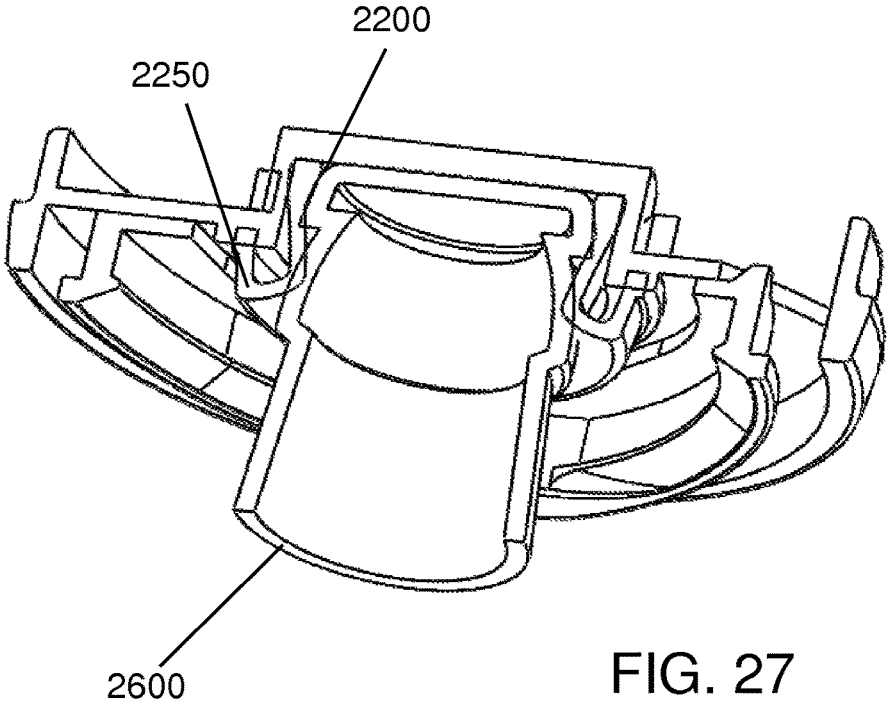

FIG. 27 is a cross-sectional perspective bottom view of the container engagement member of FIG. 22 engaging a long-neck bottle within the central gripping member of the container engagement member.

Figure 28:
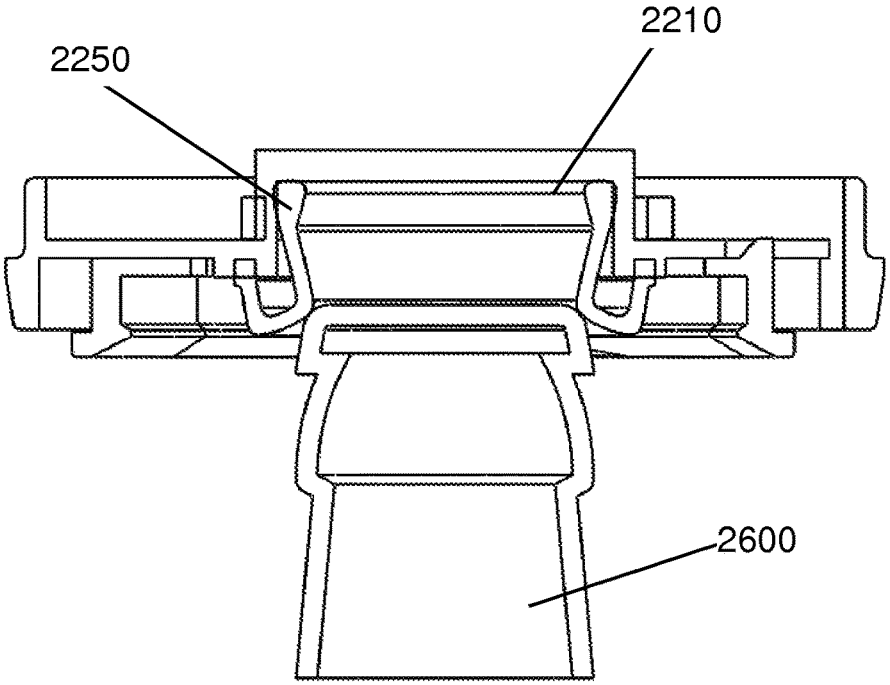

FIG. 28 is a cross-sectional side view of the container engagement member of FIG. 22 showing the insertion of a long-neck bottle within the central gripping member of the container engagement member.

Figure 29:
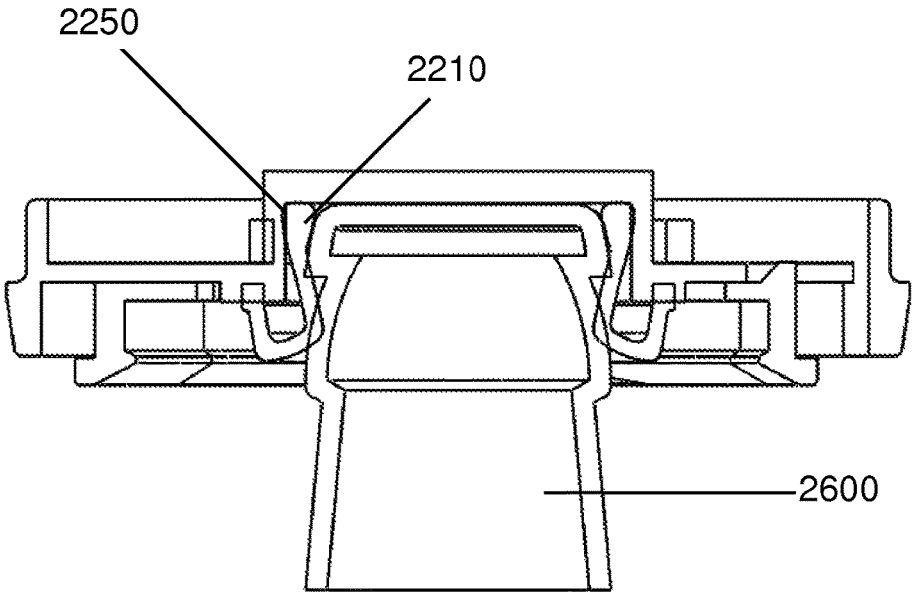

FIG. 29 is a cross-sectional side view of the container engagement member of FIG. 22 engaging a long-neck bottle within the central gripping member of the container engagement member.

Figure 30:
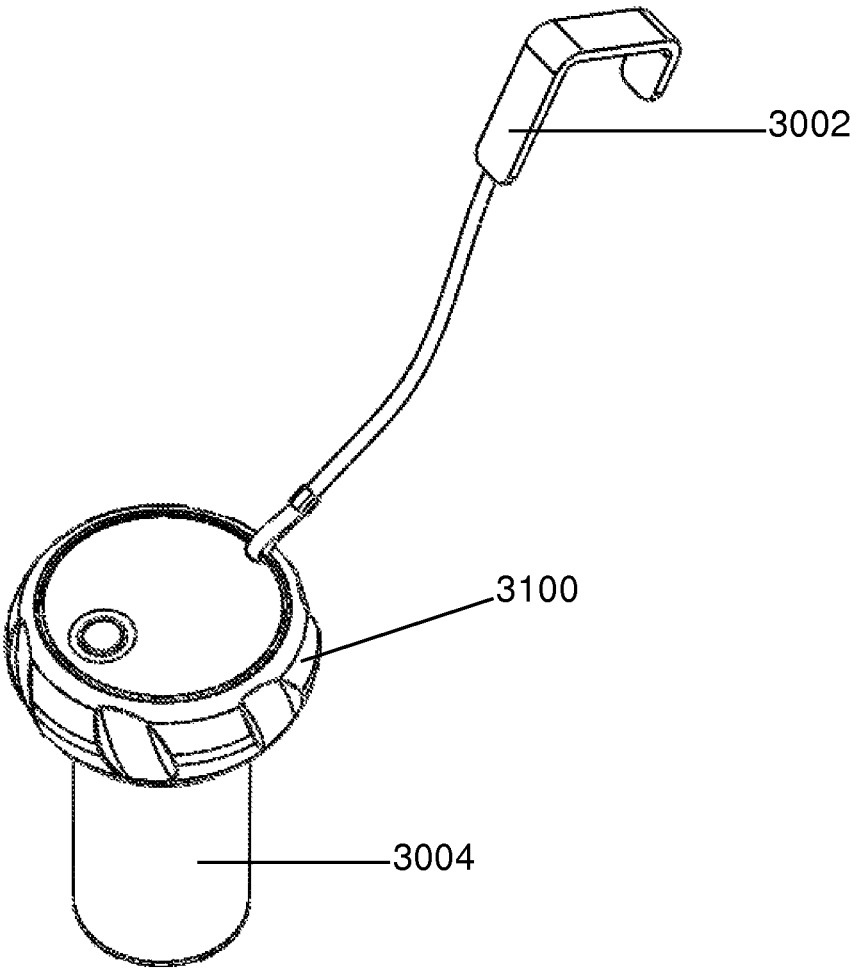

FIG. 30 is a top perspective view of one example of a hook mechanism to facilitate the hands free operation of the beverage rotating device of the present invention.

DETAILED DESCRIPTION

Figure 1:
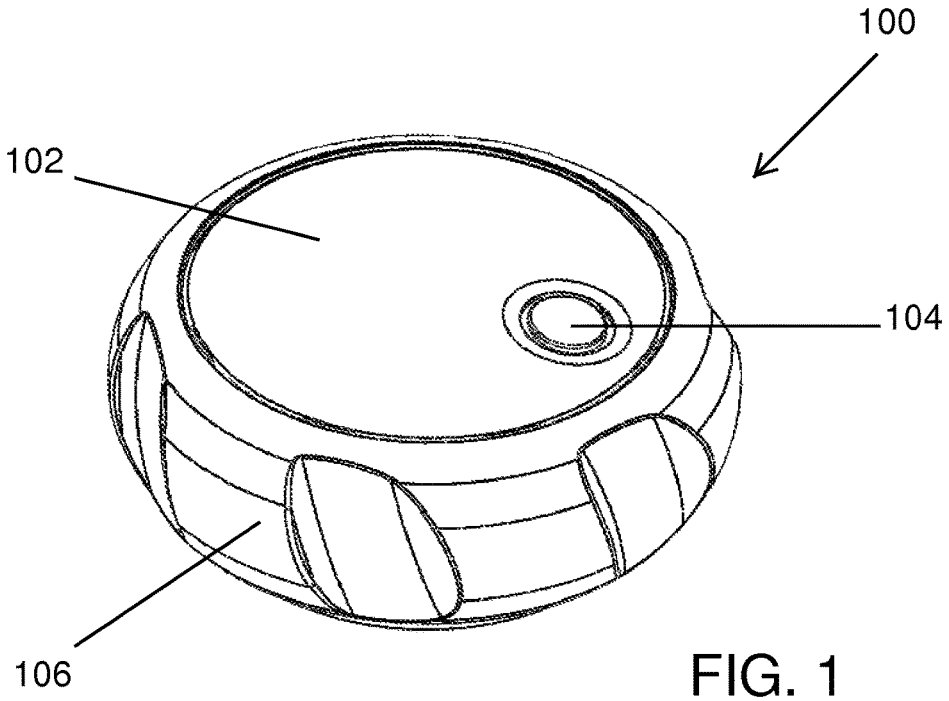
FIG. 1 is a top perspective view of one example of an implementation of a beverage cooling device of the present invention.

FIG. 1 is a top perspective view of one example of an implementation of a beverage cooling device 100 of the present invention. As illustrated in FIG. 1, the beverage cooling device 100 is a handheld device having a housing 102 with side walls 106 for encasing a motor (not shown). The motor (not shown) is contained within the housing 102 and is actuated by an on/off switch 104 to rotate a container engagement member 108 (FIG. 2).

Figure 2:
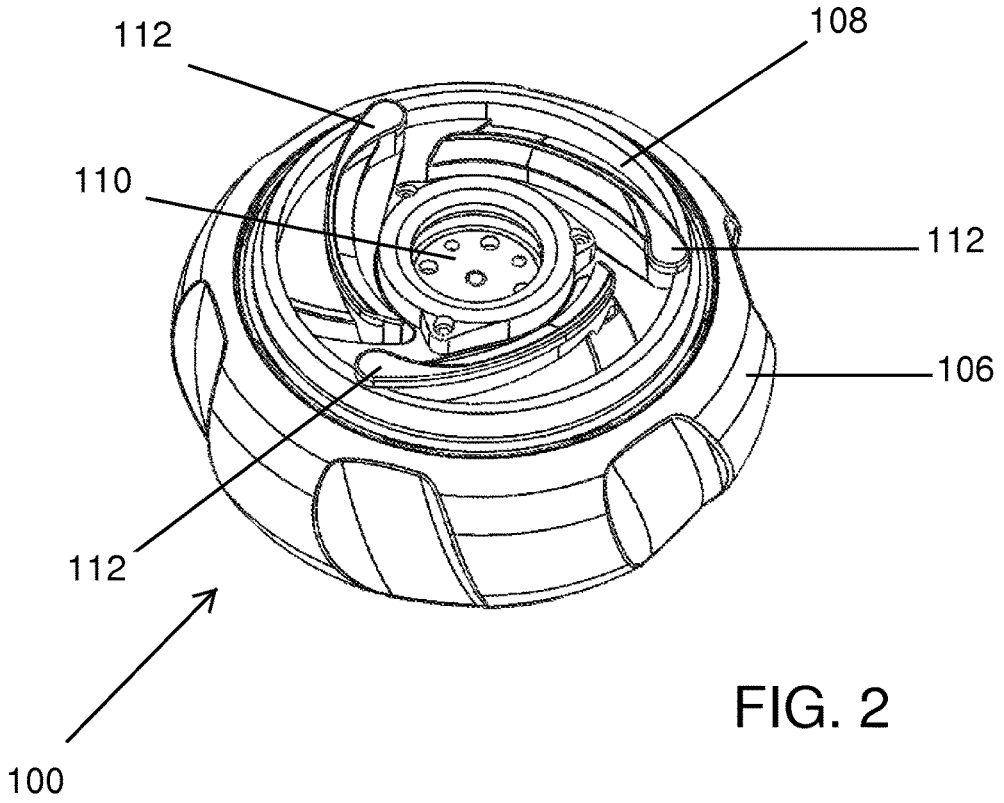
FIG. 2 is a bottom perspective view of the beverage cooling device of FIG. 1.

FIG. 2 is a bottom perspective view of the beverage cooling device 100 of FIG. 1. FIG. 2 illustrates that the beverage cooling device 100 includes a container engagement member 108 that is positioned at the bottom of side walls 106 of the housing 102. The container engagement member 108 is rotatably engaged with the motor (not shown) which is contained within the housing 102 of the beverage cooling device 100. The container engagement member 108 includes a central gripping member 110 for gripping the top of containers with long narrow necks, such as beer bottles, wine bottles and plastic single-serve beverage containers. The container engagement member 108 further includes peripheral gripping fingers 112 for engaging containers having larger circumference tops, such as aluminum beverage containers (e.g., 8 oz., 12 oz., 16 oz., 24 oz. and 32 oz. fluid containers).

As will be illustrated below, the container engagement member 108 of the beverage cooling device 100 can be implemented in different manners. FIGS. 3-14 describe one possible implementation. FIGS. 15-21 illustrate another possible implementation. FIGS. 22-29 provide yet another implementation (which is the implementation shown in FIGS. 1 and 2 above). Those skilled in the art will recognize that other possible implementations and variations may be designed and utilized without departing from the scope of the invention. Further, FIG. 30 illustrates one possible additional feature that can provide for the hands-free use of the beverage cooling device 100 of the invention.

FIG. 3 is a bottom perspective of one example of a container engagement member 108 that may be used in connection with the present invention. The container engagement member 108 includes a main cylindrical body 109 having a central gripping member 110 and slots 116 extending outward toward the outer circumference of the container engagement member 108 from the central gripping member 110. Slidably engaged within the slots 116 are peripheral gripping fingers 112. The peripheral gripping fingers 112 include front grips 114 that protrude into the central gripping member 110 when the peripheral gripping fingers 112 are in the closed position. The peripheral gripping fingers 112 further include raised grips 115 on top of the peripheral gripping fingers 112 for gripping the edges of larger containers (not shown). The peripheral gripping fingers 112 are held in a closed state by a tension member 126 (FIGS. 6-11), such as a rubber band or tension spring that joins the three peripheral gripping fingers 112.

As illustrated in connection with FIGS. 3-11, the three peripheral gripping fingers 112 are mounted on slots 116 on the main cylindrical body 109 of the container engagement member 108. The three peripheral gripping fingers 112 can be positioned to hold beverage cans and bottles of various shapes and sizes (see FIGS. 12-14). The griping fingers 112 have raised grips or hook features 115 for gripping the rim of aluminum cans 1400 (FIG. 14) and front grips 114 for gripping the necks of glass bottles 1200 and 1300 (FIGS. 12 and 13). These gripping fingers 112 are constantly pulled inward toward the center of the container engagement member 108 or toward the hub using a tension member 126 (e.g., a rubber band or tension spring).

An upper disk 117 sits atop the main cylindrical body 109 of the container engagement member 108. The disk 117 has three radially curved slots 124 that curve from the center outward toward the outer edge of the container engagement member 108. The disk 117 is rotatably attached to the main cylindrical body 109 of the container engagement member 108. The gripping fingers 112 each have upward extending pegs 122 that protrude through the three curved slots 124 on the disk 117. When the disk 117 is rotated, the slots 124 act as a cam (or ramp) to push the three gripping fingers 112 outward, away from the center of the container engagement member 108. When in a closed state, the upward extending pegs 122 of the gripping fingers 112 are positioned on the ends of radially curved slots 124 closest to the center of the container engagement member 108. As the disk 117 is rotated, the pegs 122 are moved outward along slots 116 by the radially curved slots 124 of the disk 117 moving across the upward extending pegs 122, toward the end of the radially curved slots 124 closest to the outer circumference of the container engagement member 108.

A trigger 118 is mounted rigidly to the disk 117, which allows the user to rotate the disk 117 using just a thumb and forefinger (FIGS. 3-11). This allows the disk 117 to push the three gripping fingers 112 away from the center so a beverage can be inserted. Releasing the trigger 118 causes the tension member 126 to pull the three gripping fingers 112 inward to securely hold onto the beverage. Once the beverage is secured, the entire assembly is then spun by the motor (not shown) for chilling.

FIG. 3 illustrates the peripheral gripping fingers 112 in a closed position. The peripheral gripping fingers 112 are then able to be retracted outward toward the outer circumference of the container engagement member 108 by slidably moving the peripheral gripping finger 112 along slots 116. The peripheral gripping fingers 112 are moved outward, in this example, by the engagement of the trigger 118 that is connected to the rotatable upper disk 117. The upper disk 117 is coupled to at least one peripheral gripping finger 112, as further described and illustrated in connection with FIGS. 6-11 below, and functions to move the gripping fingers 112 outward upon rotation of the upper disk 117. The trigger 118 slides along a channel 120 in the main cylindrical body 109 of the container engagement member 108. As the trigger slides along the channel 120, it moves the gripping fingers 112 outward along the path of the slots 116 and places tension on the tension member 126.

Figure 4:
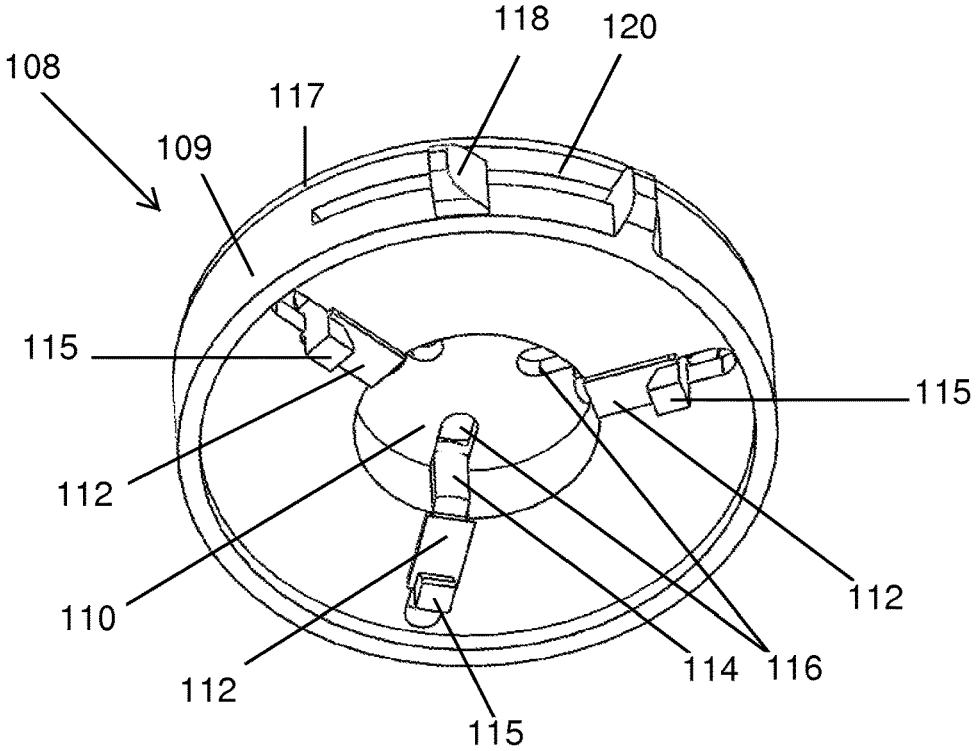
FIG. 4 is a bottom perspective view of the container engagement member of FIG. 3 illustrating the peripheral gripping fingers in a partially opened position.

FIG. 4 is a bottom-perspective view of the container engagement member 108 in FIG. 3 illustrating the peripheral gripping fingers 112 in a partially opened position. As illustrated in FIG. 4, the trigger 118 is retracted partway along channel 120, which move the peripheral gripping fingers 112 outward along the path of the slots 116, placing tension on the tension member 126. In this manner, the peripheral gripping fingers 112 are moved outward towards the outer circumference of the container engagement member 108 to allow for the insertion of a bottle or beverage container within the container engagement member 108. When the trigger 118 is released, the peripheral gripping fingers 112 are pulled inward from the release of tension on the tension member 126, thereby causing the peripheral gripping fingers 112 to compress against the top side edges of the bottle or beverage container inserted between the peripheral gripping fingers 112.

Figure 5:
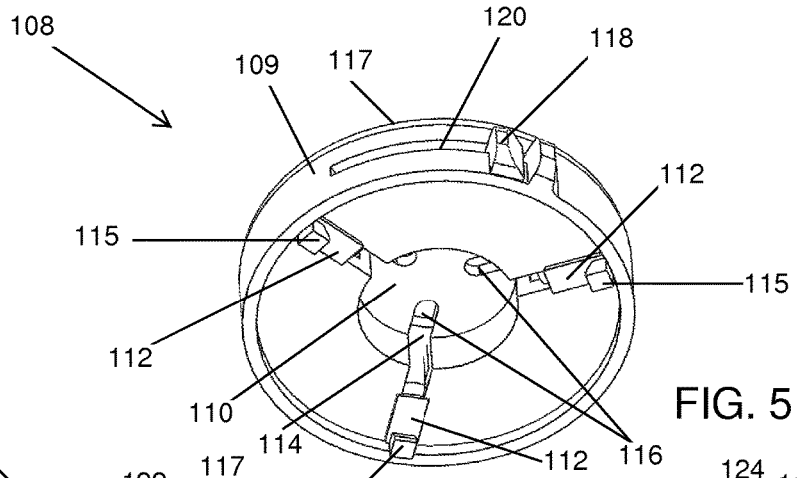
FIG. 5 is a bottom perspective view of the container engagement member of FIG. 3 illustrating the peripheral gripping fingers in a partially opened position.

FIG. 5 is a bottom perspective view of the container engagement member 108 of FIG. 3 illustrating the peripheral gripping fingers 112 in an open position. As illustrated in FIG. 5, the trigger 118 is moved from one side of the channel 120 to the other side of the channel 120 to completely retract the peripheral gripping fingers 112. The peripheral gripping fingers 112 are moved outward along the slots 116 towards the outer edges of the slots 116 near the outer circumference of the container engagement member 108 to completely open the fingers 112 for the receipt of a container. As noted above, when the trigger 118 is released, the peripheral gripping fingers 112 are pulled inward from the tension on the tension member 126, thereby causing the peripheral gripping fingers 112 to compress against the top side edges of the bottle or beverage container inserted between the peripheral gripping fingers 112.

Figure 6:
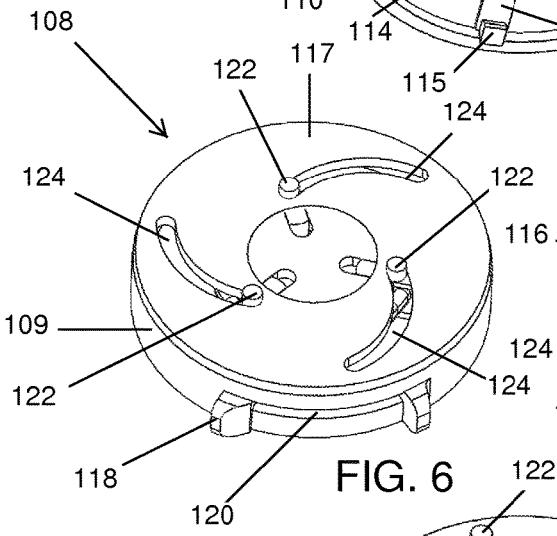
FIG. 6 is a top perspective view of the container engagement member of FIG. 3 illustrating the peripheral gripping fingers in a closed position.

FIGS. 6 through 11 illustrate the mechanical retracting of the peripheral gripping fingers 112 along the slots 116. As illustrated in FIG. 6, which is a top perspective view of the container engagement member 108, the container engagement member 108 includes an upper disk 117 also having radially curved extending slots 124 for engagement of upward extending guide peg 122 of the peripheral gripping fingers 112. As noted above, the trigger 118 mounted rigidly to the disk 117 allows the user to rotate the disk 117 and push the three gripping fingers 112 away from the center. Releasing the trigger 118 causes the tension member 126 to pull the three gripping fingers 112 inward to securely hold onto the beverage.

Figure 6A:
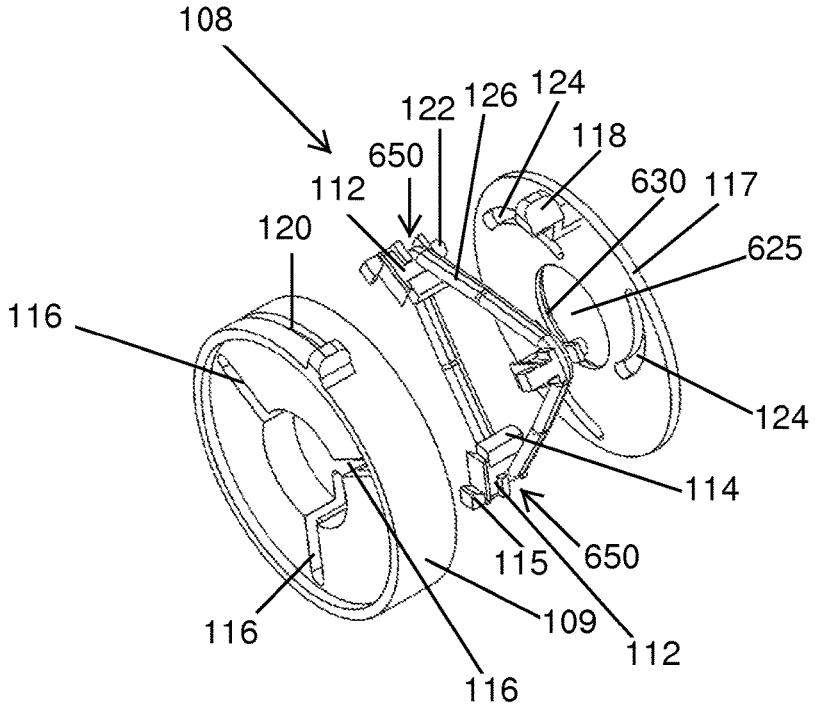
Figure 6B:
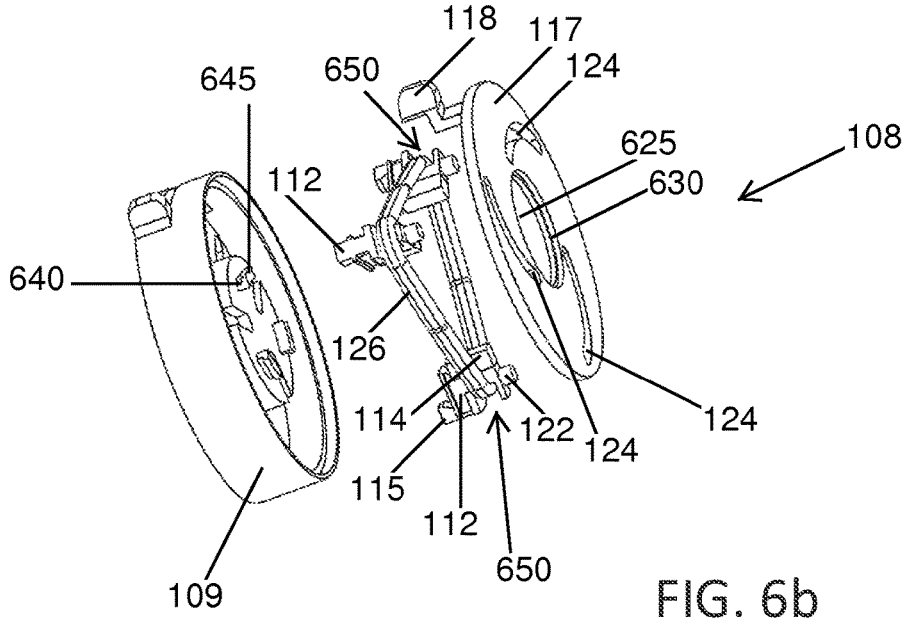

FIG. **6*a* is an exploded rear side view of the engagement member of FIG. 3 and FIG. 6*b* is an exploded top side view of the engagement member of FIG. 3. As illustrated in FIGS. 6*a* and 6*b*, the peripheral gripping fingers 112 include openings or channels 650 for engaging the tension member 126**, such as a rubber band or tension spring.

In this example, the disk 117 includes a central opening 625 having an internal channel 630 located along the interior sides of the central opening 625. On the top of the central gripping member 110 of the main cylindrical body 109 are inverted L-shaped guides 640 having top side edges 645 for coupling to the channel 630 in the central opening 625 of the disk 117. The top sides edges 645 function to snap into the channel 630 of the central opening 625 of the disk 117 for maintaining the disk 117 in a rotatable manner against the main cylindrical body 109.

Those skilled in the art will recognize that they are other means for securing the rotating disk 117 against the main cylindrical body 109. For example, the disk 117 could be held to against the main cylindrical body 109 in a rotatable manner by another part besides the engagement with the snap guides 640.

In this embodiment, the trigger 118 also operates to secure the disk 117 to the main cylindrical body 117 by molded it directly onto the rotating disc or rigidly screwing or sonically-welding it to the disk 117.

As illustrated in FIG. 7, when the trigger 118 is moved from the closed position to the open position, the disk 117 rotates. Through the engagement of the upward extending pegs 122 on the gripping fingers 112 with the radially curved slots on the disk 117, the gripping fingers 112 are slide outward along slots 116. The tension member 126 is pulled in tension from a closed to an open position, which places tension on the tension member 126. FIG. 7 illustrates the upward extending pegs 122 partially moved along the radially extending slots 126 when the trigger 118 is partially retracted from a closed to an open position, thereby moving the peripheral gripping fingers 112 outward and stretching the tension member 126.

FIG. 8 is a top-perspective view of the container engagement member 108 illustrating the peripheral gripping fingers 112 in the open position. As illustrated in FIG. 8, the trigger 118 is in the fully extended position along channel 120, thereby fully extending the tension member 126 and, through its engagement of the peripheral gripping fingers 112, moving the peripheral gripping fingers 112 outward guided by the upwardly extending pegs 122 along the radially extending slots 124.

FIG. 9 is a top plan view of the container engagement member 108 illustrating the operation of the trigger 118 to move the peripheral gripping fingers 112 from a closed to open position. As illustrated in FIG. 9, the tension member 126 is in a relaxed state when the peripheral gripping fingers 112 are in the closed position. Upon the retraction of one peripheral gripping finger 112 by the movement of the trigger 118 along channel 120, the tension member 126, by virtue of its interconnection with all of the peripheral gripping fingers 112, expands outward when the peripheral gripping fingers 112 are moved outward in the slots 116 by the movement of the disk 117 containing the radial extending slots 124 across the upward extending pegs 122. While the tension member 126 in the illustrated example is a rubber ring, it is recognized by those skilled in the art that the tension member 126 can be made of other materials having compression/decompression properties, for example, a metal extension spring.

FIG. 10 illustrates the tension member 126 in a partially extended position, where the peripheral gripping fingers 112 are moved to a partially open state. FIG. 11—illustrates the tension member 126 in the fully extended position having retracted the peripheral gripping fingers 112 to the outer circumference of the container engagement member 108 along the radially extending slots 116 and 124.

FIG. 12 is a cross-section view of the container engagement member 108 of FIGS. 3-13 with a long-neck bottle 1200, such as a beer bottle, retained within the central gripping member 110. In operation, the peripheral gripping fingers 112 are partially opened to allow the central gripping member 110 to be completely cleared of the peripheral gripping fingers 112. The neck of the long-neck bottle 1200 is inserted into the central gripping member 110 and the peripheral gripping fingers 112 are then released to the closed position. Upon release, the front grips 114 of the peripheral gripping fingers 112 extend forward into the central gripping member 110 to engage the bottle top or bottle cap on the long-neck bottle 1200. In this manner, the long-neck bottle 1200 is engaged within the central gripping member 110 by the compressive force of the front grips 114 on the long-neck bottle 1200.

FIG. 13 illustrates the operation of the container engagement member 108 illustrated in FIGS. 3-11 in connection with a wine bottle 1300. FIG. 12 is a cross-section view of the container engagement member 108 of FIGS. 3-13 with a wine bottle 1300 retained within the central gripping member 110. In operation, the peripheral gripping fingers 112 are partially opened to allow the central gripping member 110 to be completely cleared of the peripheral gripping fingers 112. The wine bottle neck is inserted into the central gripping member 110 and the peripheral gripping fingers 112 are then released to the closed position. Upon release, the front grips 114 of the peripheral gripping fingers 112 extend forward into the central gripping member 110 to engage the wine bottle top or wine bottle cap on the wine bottle 1300. In this manner, the wine bottle 1300 is engaged within the central gripping member 110 by the compressive force of the front grips 114 on the bottle top 1300.

FIG. 14 illustrates the operation of the container engagement member 108 illustrated in FIGS. 3-11 in connection with an aluminum container 1400. FIG. 14 is a cross-section view of the container engagement member 108 of FIGS. 3-13 with the aluminum container 1400 retained by the raised grips 115 on the peripheral gripping fingers 112. In operation, the peripheral gripping fingers 112 are partially opened to allow the peripheral gripping fingers 112 to be cleared of the circumference of the can top being inserted into the container engagement member 108. The aluminum container 1400 is place against the container engagement member 108 and then the peripheral gripping fingers 112 are released to the closed position. Upon release, the raised grips 115 of the peripheral gripping fingers 112 engage the top edge of the aluminum container 1400. In this manner, the aluminum container 1400 is engaged between the raised grips 115 of the peripheral gripping fingers 112 by the compressive force of the raised grips 115 on the aluminum container top 1400.

FIG. 15 is a side rear perspective view of another example of an implementation of a container engagement member 1508 that may be utilized in connection with the present invention. The container engagement member 1508 in this example acts as a rubber gasket for engaging a long-neck bottle 1200 or wide-mouth topped aluminum-type cans 1400.

As illustrated in FIG. 16, which is a cross-sectional side view of the container engagement member 1508 of FIG. 15, the container engagement member 1508 also includes a central gripping member 1510 for engaging a long-neck typed bottle such as a beer bottle 1200 or wine bottle 1300. The area between the central gripping member 1510 and the outer circumference of the container engagement member 108 includes stair-stepped tiered concentric engaging members 1532 that are each sized to fit different sized aluminum cans tops 1400. The smaller circular gripping steps could, for example, grip an 8 oz. can, whereas the largest step could grip a 32 oz. can.

FIG. 17 illustrates a side cross-sectional view of the container engagement member 1508 engaging a long-neck bottle 1200 within the central gripping member 1510. In operation, the central gripping member 1510 is an expandable rubber flange having a circumference slightly less than the diameter of the long-necked bottle, such that when the long-neck bottle 1200 is inserted into the central gripping member 1510, the central gripping member 1510 tightly engages the top of the bottle.

Similarly, FIG. 18 is a cross-sectional side view of the container engagement member 1508 of FIG. 15 which illustrates a wine bottle 1300 being engaged by the central gripping member 1510 of the container engagement member 1508. The wine bottle 1300 is positioned within the central gripping member 1510 such that a friction grip is formed around the top of the wine bottle 1300, holding the bottle against the container engagement member 1508 for rotation upon activation of the motor.

FIGS. 19, 20 and 21 illustrate the stair-stepped or tiered concentric engaging members 1532 gripping the tops of various sized cans 1900, 2000 and 2100 within the four concentric increasingly circumference-sized rings. The stair-stepped or tiered concentric engaging members 1532 are angled inward such that the top of the aluminum container 1400 is positioned within the appropriately sized concentric rings of the stair-stepped or tiered gripping members 1532. When inserted, a friction fit is formed between the gripping members 1532 of the container engagement member 1508 to frictionally engage and grip the tops 1902, 2002 and 2102 of containers 1900, 2000 and 2100.

FIG. 22 illustrates yet another example of an implementation of the container engagement member 2208. As illustrated in FIG. 22, the bottom portion of the container engagement member 2208 includes peripheral gripping fingers 2212, slideable from a closed to a retracted and open position along slots 2216. One end of each peripheral gripping finger 2212 forms a stationery pivot point 2240 about the container engagement member 2208. The opposing end of the peripheral gripping fingers 2212 includes a hooked member 2242 for engaging a tension member 2226 such as a rubber band or spring. Each one of the peripheral gripping fingers 2212 further include a raised outer edge 2244 for engaging the sides of the top of an aluminum can inserted into the containing engaging member 2208. Raised outer edges 2244 may also be characterized as lips 2244 on the outer edge of the peripheral gripping fingers 2212.

FIG. 23 is a bottom-perspective view of the peripheral gripping fingers 2212 in the open and fully retracted position. In this manner, the tension member 2226 is fully extended such that compressive force is placed upon the peripheral gripping fingers 2212 toward the inner portion of the container engagement member 2208. In this manner, a larger mouthed beverage container or aluminum can 1400 may be placed within the opening defined by the lips 2244 of the peripheral gripping fingers 2212 and upon release, the lips 2244 can engage the top of the aluminum can 1400 creating compressive force around the top of the can, thereby engaging the top of the can within the container engagement member 2208.

FIG. 24 is a side-perspective view illustrating the container engagement member 2108 in the closed position, while FIG. 25 illustrates the container engagement member 2208 in the open position. FIGS. 24 and 25 best illustrate the tension member 2226 moving from a relaxed to an expanded state to create compressive force inward upon release. FIGS. 24 and 25 also illustrate the lips 2244 raised from the peripheral gripping fingers 2212 along the outer circumferential edge of the peripheral gripping fingers 2212.

As illustrated in FIG. 26, the container engagement member 2208 also includes a central gripping member 2210 that may include a rubber gripping flange 2250. The rubber gripping flange 2250 is used to grip the top of the long-neck bottle container 2600 upon insertion into the central opening 2210.

As illustrated in FIGS. 27, 28 and 29, when the long-neck bottle 2600 is inserted into the central opening 2210, the rubber flange member 2250 is compressed outward creating a tight friction fit to maintain the top of the bottle neck 2600 within the central gripping member 2210.

FIG. 30 is a top perspective view of one example of a hook mechanism 3001 to facilitate the hands free operation of the beverage rotating device 3000 of the present invention. In operation, the beverage cooling device 100 sometimes spins in the opposite direction as the beverage in the container. This counter-spinning reduces the rotational speed of the contents by half and thereby decreases the cooling efficiency.

By adding a lanyard or other hooking device 3002 over the side of the ice cooler or container, it helps to stabilize the beverage cooling device 3000 to prevent it from rotating so all of the spinning is isolated to the beverage. When sold or used with a hook or lanyard device 3002, the beverage cooling device 3000 may be designed with an integrated loop feature that allows any type of strap to be attached.

Additional features of the beverage cooling device 3000 may include a removable and interchangeable outer body 3004. As illustrated in the examples of FIG. 1-30, the device may include a soft foam-rubber outer body that is detachable from a motor housing. The foam-rubber bodies may be designed to be detachable and interchangeable. As such, the bodies may come in a variety of colors and may be designed with certain indicia, such as personalized designs, sport team or school colors or logos, company logos or other unique or representative designs tailored for different markets. Further, the foam-rubber may be designed to be buoyant.

Additionally, the body may include sculpted cut-out features that may be increased in depth to act as a grip on the ice during spinning. The deeper the cutouts, the more traction may be possible for the device when immersed in ice or slush. This may help stabilize the body so all the spinning takes place with the beverage. The foam-rubber is also buoyant.

Optionally, the device may include a timer and/or LED light indicators (not shown) that show the status of the device when spinning. Further, electronics may be included that control the duration of the spinning, for example from 2-4 minutes with an auto-shutoff. Colored or blinking lights may notify the user of the status.

It will be apparent to those skilled in the art that the beverage cooling device 100 of the present invention can be used with an open beverage. Hence, the beverage cooling device 100 can be used to quickly cool a partially consumed beverage, thus avoiding waste or, in the alternative, drinking the beverage warm. The beverage cooling device 100 may be used with plastic, glass or aluminum containers or bottles.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A handheld beverage cooling device for engaging and rotating a beverage container, the handheld beverage cooling device comprising:

a motor;

a housing having a top, bottom and side walls for housing the motor;

a container engagement member rotatably attached to the motor such the container engagement member is able to rotate when the motor is actuated;

the container engagement member comprising:

a central gripping member for engaging a container having a top of at least a first circumference;

a plurality of peripheral gripping members for engaging a container having a top of at least a second circumference, larger than the first circumference; and a tension member configured to apply a force to the peripheral gripping member to engage the container having a top of at least the second circumference, whereby the motor is configured to rotate the container engagement member when actuated enabling rotation of an engaged container when engaged by the container engagement member of the beverage cooling device.

2. The handheld beverage cooling device of claim 1, wherein the housing further comprises a removable foam-rubber outer body.

3. The handheld beverage cooling device of claim 2, where the foam-rubber outer body includes tailor designs for different target market segments.

4. The handheld beverage cooling device of claim 2 where the removable foam-rubber outer body is buoyant.

5. The handheld beverage cooling device of claim 1, wherein the attachment of the housing and container engagement member creates a water-tight seal for the motor.

6. The handheld beverage cooling device of claim 1 where the housing includes sculpted cut-out features to act as a grip on ice while the beverage cooling device rotates the engaged container.

7. The handheld beverage cooling device of claim 1 where the housing includes a timer communicatively coupled to the motor with an automatic shut-off.

8. The handheld beverage cooling device of claim 1 further including one or more light indicators configured to show the status of the device in operation.

9. The handheld beverage cooling device of claim 1, wherein the tension member is further configured to apply a force to the central gripping member to engage the container having a top of at least the first circumference.

10. The handheld beverage cooling device of claim 1, wherein the peripheral gripping members comprise a plurality of gripping fingers each coupled to the tension member, each of the gripping fingers comprising a raised grip for gripping the container having a top of at least the second circumference.

11. The handheld beverage cooling device of claim 10, wherein the gripping fingers comprises a range of movement between an opened position and a closed position, and the tension member is configured to apply the force to the gripping fingers through the range of movement, to engage a container having a top of a range of circumferences between the opened position and closed position.

12. The handheld beverage cooling device of claim 10, wherein each of the gripping fingers is coupled to the container engagement member at a respective fixed pivot point, and wherein the raised grip is at an opposing end of each respective gripping finger relative to its fixed pivot point.

13. The handheld beverage cooling device of claim 12, wherein the container engagement member comprises a rotatable disk comprising a plurality of slots, and wherein each of the gripping fingers further comprises a peg extending through a respective one of the slots, such that rotation of the disk engages the slots with their respective pegs and pivots the gripping fingers about their respective fixed pivot points to open the container engagement member.

14. The handheld beverage cooling device of 10, wherein the container engagement member comprises a rotatable disk comprising a plurality of slots, and wherein each of the gripping fingers further comprises a peg extending through a respective one of the slots, such that rotation of the disk engages the slots with their respective pegs and pushes the gripping fingers radially outward to open the container engagement member.

15. The handheld beverage cooling device of claim 1, wherein the peripheral gripping members comprise a plurality of tiered concentric engaging members each configured to fit containers having different respective circumferences.

16. A handheld beverage cooling device for engaging and rotating a beverage container, the handheld beverage cooling device comprising:

a motor;

a housing having a top, bottom, and side walls for housing the motor;

a container engagement member rotatably attached to the motor such that the container engagement member is able to rotate when the motor is actuated;

the container engagement member comprising:

a central gripping member for engaging a container having a top of at least a first circumference; and a plurality of tiered concentric engaging members each configured to fit containers having different respective circumferences, each greater than the first circumference, whereby the motor is configured to rotate the container engagement member when actuated enabling rotation of an engaged container when engaged by the container engagement member of the beverage cooling device.

17. The handheld beverage cooling device of claim 16, wherein the attachment of the housing and container engagement member creates a water-tight seal for the motor.

18. The handheld beverage cooling device of claim 16, where the housing includes sculpted cut-out features to act as a grip on ice while the beverage cooling device rotates the engaged container.

19. The handheld beverage cooling device of claim 16, wherein the tiered concentric engaging members comprise angled surfaces having a smaller circumference in the direction of an engaged container, configured for a friction fit with the containers having the respective circumferences.

20. The handheld beverage cooling device of claim 16, wherein the central gripping member comprises an expandable rubber flange having a circumference less than the first circumference for tightly engaging the container having a top of at least the first circumference.

* * * * *